US008037940B2

(12) United States Patent
Patel et al.

(10) Patent No.: US 8,037,940 B2
(45) Date of Patent: Oct. 18, 2011

(54) METHOD OF COMPLETING A WELL USING A RETRIEVABLE INFLOW CONTROL DEVICE

(75) Inventors: Dinesh R. Patel, Sugar Land, TX (US); Terje Moen, Sandnes (NO); Arthur H. Dybevik, Sandnes (NO)

(73) Assignee: Schlumberger Technology Corporation, Sugar Land, TX (US)

( * ) Notice: Subject to any disclaimer, the term of this patent is extended or adjusted under 35 U.S.C. 154(b) by 176 days.

(21) Appl. No.: 12/205,196

(22) Filed: Sep. 5, 2008

(65) Prior Publication Data

US 2009/0065199 A1 Mar. 12, 2009

Related U.S. Application Data

(60) Provisional application No. 60/970,710, filed on Sep. 7, 2007.

(51) Int. Cl.
*E21B 34/08* (2006.01)

(52) U.S. Cl. ..... 166/386; 166/167; 166/168; 166/325; 166/373

(58) Field of Classification Search ..... 166/313, 166/373, 386, 167, 168, 169, 325, 328
See application file for complete search history.

(56) References Cited

U.S. PATENT DOCUMENTS

| | | | | | |
|---|---|---|---|---|---|
| 2,919,709 | A | * | 1/1960 | Schwegman | 137/68.17 |
| 3,065,794 | A | * | 11/1962 | Page | 166/125 |
| 3,087,551 | A | * | 4/1963 | Kerver | 166/317 |
| 3,371,717 | A | * | 3/1968 | Chenoweth | 166/147 |
| 3,473,609 | A | * | 10/1969 | Allen | 166/317 |
| 3,554,281 | A | * | 1/1971 | Ecuer | 166/155 |
| 3,603,394 | A | * | 9/1971 | Raulins | 166/325 |
| 3,954,138 | A | * | 5/1976 | Miffre | 166/188 |
| 4,470,464 | A | * | 9/1984 | Baldenko et al. | 166/325 |
| 4,478,279 | A | * | 10/1984 | Puntar et al. | 166/121 |
| 4,691,777 | A | * | 9/1987 | Williamson, Jr. | 166/319 |
| 5,012,867 | A | * | 5/1991 | Kilgore | 166/188 |
| 5,320,181 | A | * | 6/1994 | Lantier et al. | 166/386 |
| 6,102,060 | A | * | 8/2000 | Howlett et al. | 137/1 |
| 6,302,216 | B1 | | 10/2001 | Patel | |
| 6,330,913 | B1 | | 12/2001 | Langseth et al. | |
| 6,354,378 | B1 | | 3/2002 | Patel | |

(Continued)

FOREIGN PATENT DOCUMENTS

| | | | |
|---|---|---|---|
| GB | 2362669 | A | 11/2001 |

(Continued)

*Primary Examiner* — Jennifer H Gay
(74) *Attorney, Agent, or Firm* — David G. Matthews; Rodney V. Warfford; Robert Van Someren

(57) ABSTRACT

A retrievable flow control device comprising a housing configured to sealably couple with a completion component. The housing may comprise a first port and a second port establishing a fluid pathway. The fluid pathway may regulate a fluid flow as the fluid flow passes through the fluid pathway. The housing may further comprise a coupling mechanism configured to releasably couple with a corresponding feature of the wellbore completion. The downhole flow control device may be configured to be retrievable independently of the completion component. The flow control device may comprise a check valve in the fluid pathway in order to substantially constrain the fluid flow to a single direction. In some cases, the flow control device may be configured to couple with a side pocket. In other cases, a concentric flow control device may be configured to couple with a screen base pipe, tubing, or stinger.

7 Claims, 12 Drawing Sheets

U.S. PATENT DOCUMENTS

| | | | | |
|---|---|---|---|---|
| 6,371,206 | B1 * | 4/2002 | Mills | 166/311 |
| 6,679,332 | B2 * | 1/2004 | Vinegar et al. | 166/373 |
| 6,695,049 | B2 * | 2/2004 | Ostocke et al. | 166/97.1 |
| 6,705,404 | B2 * | 3/2004 | Bosley | 166/372 |
| 6,886,634 | B2 * | 5/2005 | Richards | 166/278 |
| 6,907,926 | B2 * | 6/2005 | Bosley | 166/108 |
| 6,973,974 | B2 * | 12/2005 | McLoughlin et al. | 166/386 |
| 6,989,764 | B2 * | 1/2006 | Thomeer et al. | 340/853.2 |
| 7,021,385 | B2 * | 4/2006 | Ohmer et al. | 166/324 |
| 7,240,739 | B2 | 7/2007 | Schoonderbeek et al. | |
| 7,296,624 | B2 | 11/2007 | Rodet et al. | |
| 7,385,523 | B2 * | 6/2008 | Thomeer et al. | 340/854.8 |
| 2002/0070027 | A1 * | 6/2002 | Ohmer et al. | 166/373 |
| 2003/0066653 | A1 * | 4/2003 | Ohmer et al. | 166/373 |
| 2004/0016549 | A1 * | 1/2004 | Selinger et al. | 166/369 |
| 2004/0079531 | A1 * | 4/2004 | Smith et al. | 166/373 |
| 2005/0092488 | A1 | 5/2005 | Rodet et al. | |
| 2006/0027377 | A1 | 2/2006 | Schoonderbeek et al. | |
| 2009/0032267 | A1 * | 2/2009 | Cavender et al. | 166/386 |
| 2009/0065199 | A1 * | 3/2009 | Patel et al. | 166/250.01 |

FOREIGN PATENT DOCUMENTS

| | | | |
|---|---|---|---|
| GB | 2410049 | A | 7/2005 |
| GB | 2423782 | A | 9/2006 |
| WO | 0029715 | A1 | 5/2000 |
| WO | 0043634 | A2 | 7/2000 |

* cited by examiner

METHOD OF COMPLETING A WELL USING A RETRIEVABLE INFLOW CONTROL DEVICE

RELATED APPLICATIONS

This application claims the benefit of U.S. Provisional Application No. 60/970710, filed Sep. 7, 2007, the contents of which are incorporated herein.

BACKGROUND

1. Field of the Invention

Embodiments of the present invention generally relate to inflow control devices used for producing hydrocarbon or injecting water with uniform flow across a reservoir, and more particularly to retrievable inflow control devices.

2. Description of the Related Art

The following descriptions and examples are not admitted to be prior art by virtue of their inclusion in this section.

Intelligent flow control valves with variable chokes are typically run above the screen or inside of the screen for controlling the flow from each zone of interest. A hydraulic control line or an electric cable is run from the surface to the valve for operating the flow control valve. Intelligent completions are generally complex and expensive. Therefore, permanent mounted inflow control devices (ICD) are run in the completion as an integral part of the screen or slotted liner in order to simplify the completion and reduce cost. The choke size of the ICD is predetermined at the surface before installation in the well based on the knowledge of the reservoir. However, it has not been possible to vary the choke size of the permanent mount ICD without pulling the completion out of the well.

SUMMARY

In accordance with one embodiment of the invention, a downhole flow control device may comprise a housing configured to sealably couple with a completion component. The housing may comprise a first port and a second port establishing a fluid pathway. A fluid flow may be regulated as the fluid flow passes through the fluid pathway. The housing may further comprise a coupling mechanism configured to releasably couple with a corresponding feature of the wellbore completion. The downhole flow control device may be configured to be retrievable independently of the completion component.

In accordance with another embodiment of the invention, a method of completing a well may comprise installing an expandable sand screen comprising one or more retrievable flow control devices. The one or more retrievable flow control devices may correspond to one or more formation zones. The method may further comprise producing fluid from the formation zones or injecting fluid into the formation zones. The method may comprise monitoring a well parameter from each of the one or more formation zones. In addition, the method may comprise retrieving at least one of the retrievable flow control devices and replacing it with another retrievable flow control device based upon the monitoring results.

Other or alternative features will become apparent from the following description, from the drawings, and from the claims.

BRIEF DESCRIPTION OF THE DRAWINGS

Certain embodiments of the invention will hereafter be described with reference to the accompanying drawings, wherein like reference numerals denote like elements. It should be understood, however, that the accompanying drawings illustrate only the various implementations described herein and are not meant to limit the scope of various technologies described herein. The drawings are as follows.

DETAILED DESCRIPTION

As used here, the terms "up" and "down"; "upper" and "lower"; "upwardly" and "downwardly"; "below" and "above"; and other similar terms indicating relative positions above or below a given point or element may be used in connection with some implementations of various technologies described herein. However, when applied to equipment and methods for use in wells that are deviated or horizontal, or when applied to equipment and methods that when arranged in a well are in a deviated or horizontal orientation, such terms may refer to a left to right, right to left, or other relationships as appropriate.

In the following description, numerous details are set forth to provide an understanding of the present invention. However, it will be understood by those skilled in the art that the present invention may be practiced without these details and that numerous variations or modifications from the described embodiments are possible.

In accordance with an embodiment of the invention, a retrievable passive inflow control device (RPICD) is disclosed for producers and injectors. The inflow control device has a fluid passageway that regulates the flow. The fluid passageway of the inflow control device may be an orifice or a torturous passageway, among other examples. The RPICD can be retrieved to the surface in order to change out the choke size to suit new reservoir conditions and then reinstalled back in the completion. A slick line, wireline, coiled tubing or pipe could be used to retrieve the RPICD. With such a device, there would be no need for pulling the completion out of the hole for changing the ICD choke size. The RPICD could be run as an integral part of the wire wrapped screen, or deployed on a stinger inside of the expandable screen. The RPICD could be of concentric design or side pocket mounted design. The side pocket mandrel could be run with a lower completion, e.g., wire wrapped screen, or it could be run on a stinger inside of the expandable screen, cased and perforated liner, wire wrapped screen, slotted liner, etc.

Figure 1:
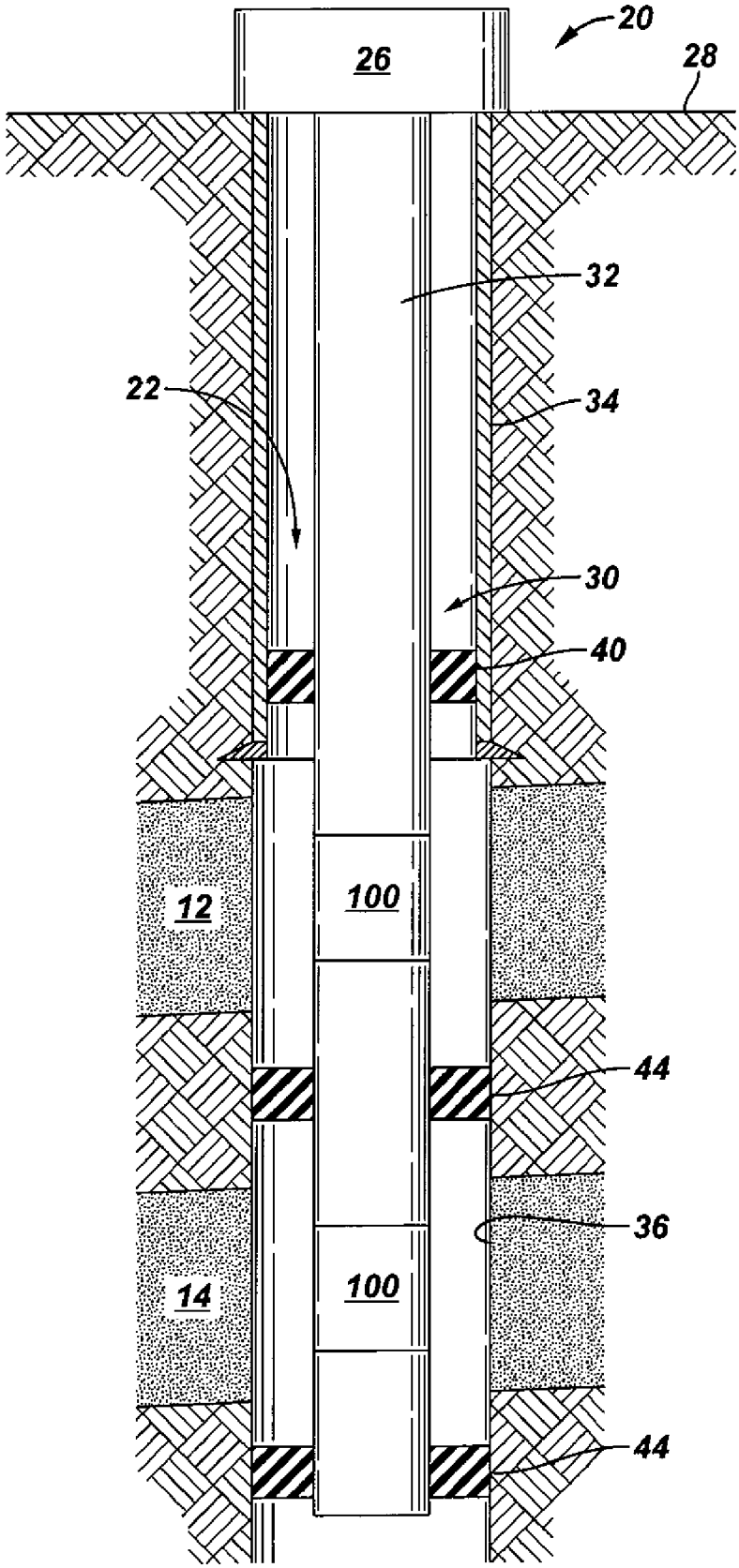
FIG. 1 is a front elevation view of a retrievable flow control system deployed downhole, according to an embodiment of the present invention.

Referring generally to FIG. 1, an example of a well system 20 is deployed in a wellbore 22 according to one embodiment of the present invention. The wellbore 22 is illustrated as extending downwardly into subterranean formation zones 12 and 14 from a wellhead 26 positioned at a surface location 28. However, the well system 20 can be utilized in a variety of wells having generally vertical or deviated, e.g. horizontal wellbores. Additionally, the well system 20 can be employed in a variety of environments and applications, including land-based applications and subsea applications.

In the embodiment illustrated, well system 20 comprises a completion 30 deployed within wellbore 22 via, for example, a tubing 32. In many applications, completion 30 is deployed within a cased wellbore having a casing 34, however the completion 30 also can be deployed in an open bore 36 application. As illustrated, completion 30 may comprise one or more retrievable flow control devices (FCD) 100. The one or more retrievable FCD 100 may be used to control the flow of fluid between the tubing 32 and the surrounding formation zones 12 and 14. In some embodiments, the one or more retrievable FCD 100 may be used to control the flow of injection fluid from the production tubing 32 into the formation zones 12 and 14 as well as inhibiting or preventing the backflow of fluid from the formation zones 12 and 14 into the production tubing 32. Of course, the one or more retrievable FCD 100 may be used to control the rate of flow of production fluid from the surrounding formation zones 12 and 14 into the production tubing 32. The formation zones 12 and 14 may be separated into sections for corresponding FCD 100s by formation isolation devices such as casing packers 40 and open hole packers 44.

Figure 2:
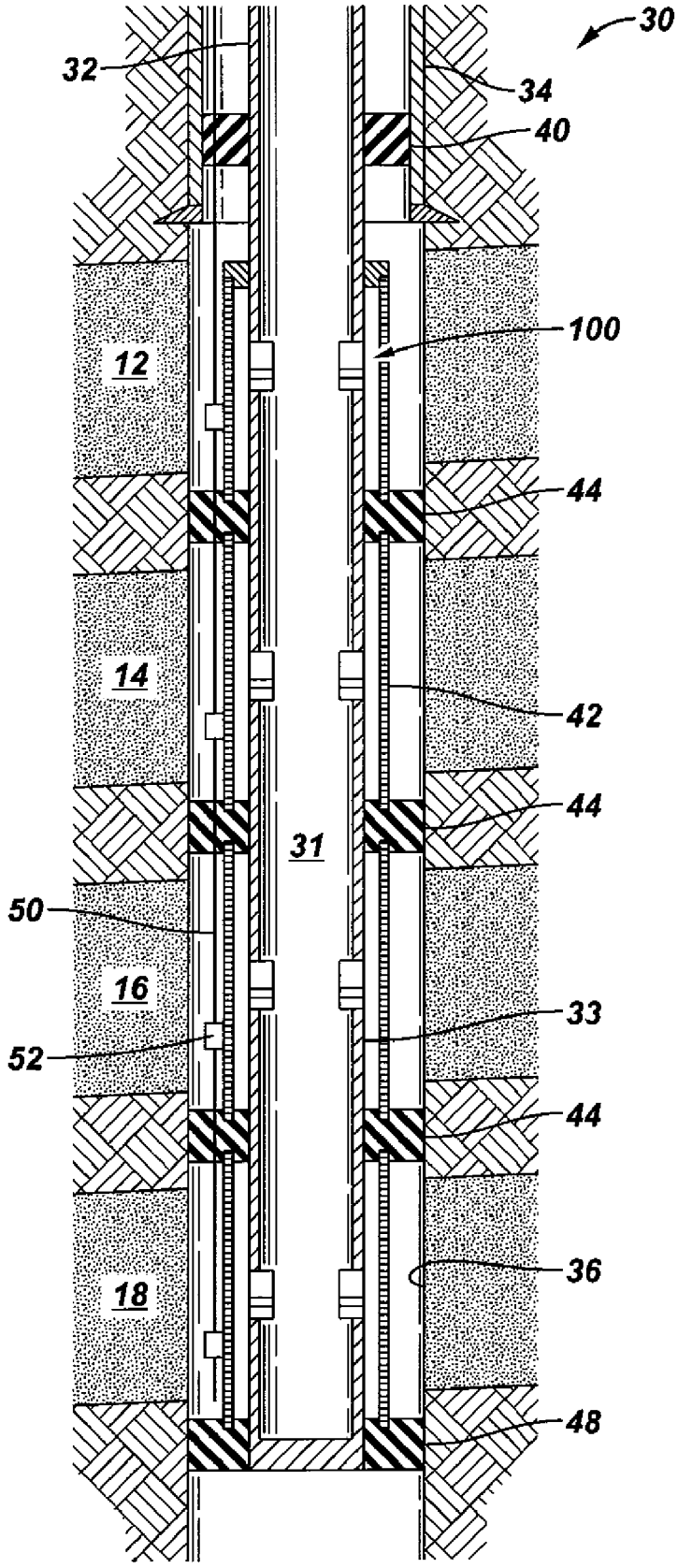
FIG. 2 is a front cross-sectional view of a retrievable concentric flow control device run on an inner tubing string inside of a sand screen, in accordance with an embodiment of the invention.

Referring generally to FIG. 2, this drawing shows an enlarged detail view of an illustrative example of a completion 30 comprising one or more retrievable FCDs 100 (four are shown in this example). The completion 30 may be run along with the production tubing 32. At the end of the casing 34, a screen hanger packer 40 may couple and support the completion 30 in the open bore 36, as well as seal the interior of the casing 34 from the open hole formation zones 12, 14, 16, and 18. The interior 31 of the completion 30 may be further sealed from the open wellbore by an end of tubing device 48.

In some cases, completion 30 may comprise a screen base pipe 33. Screen base pipe 33 may be configured to removably support the retrievable FCDs 100 and one or more screens 42, depending upon the type and application of the well 20 (see FIG. 1). The screens 42 may be configured to filter out contaminants such as sand from entering into the interior 31 of the completion 30. In some cases, expandable sand screens may be used for screens 42. The screens 42 may be separated into sections for the corresponding formation zones 12, 14, 16, and 18, by open bore isolation packers 44.

Completion 30 may further comprise a sensor bridal 50 including one or more sensors 52. The sensors 52 may be for monitoring physical parameters of the well, such as flow rate, temperature, and resistivity, among others. The sensor bridal 50 may also be used to control intelligent completion devices (not shown) and establish a communication pathway between the surface 28 (FIG. 1) and the interior of the well. As shown in FIG. 2, four sensors 52 may be provided to monitor conditions for each of the formation zones 12, 14, 16, and 18. However, the sensors 52 may be incorporated into the sensor bridal 50. For example, the sensor bridal 50 may comprise a fiber optic cable, thereby permitting the establishment of a distributed temperature system configured to determine temperatures throughout the length of the well.

Figure 3:
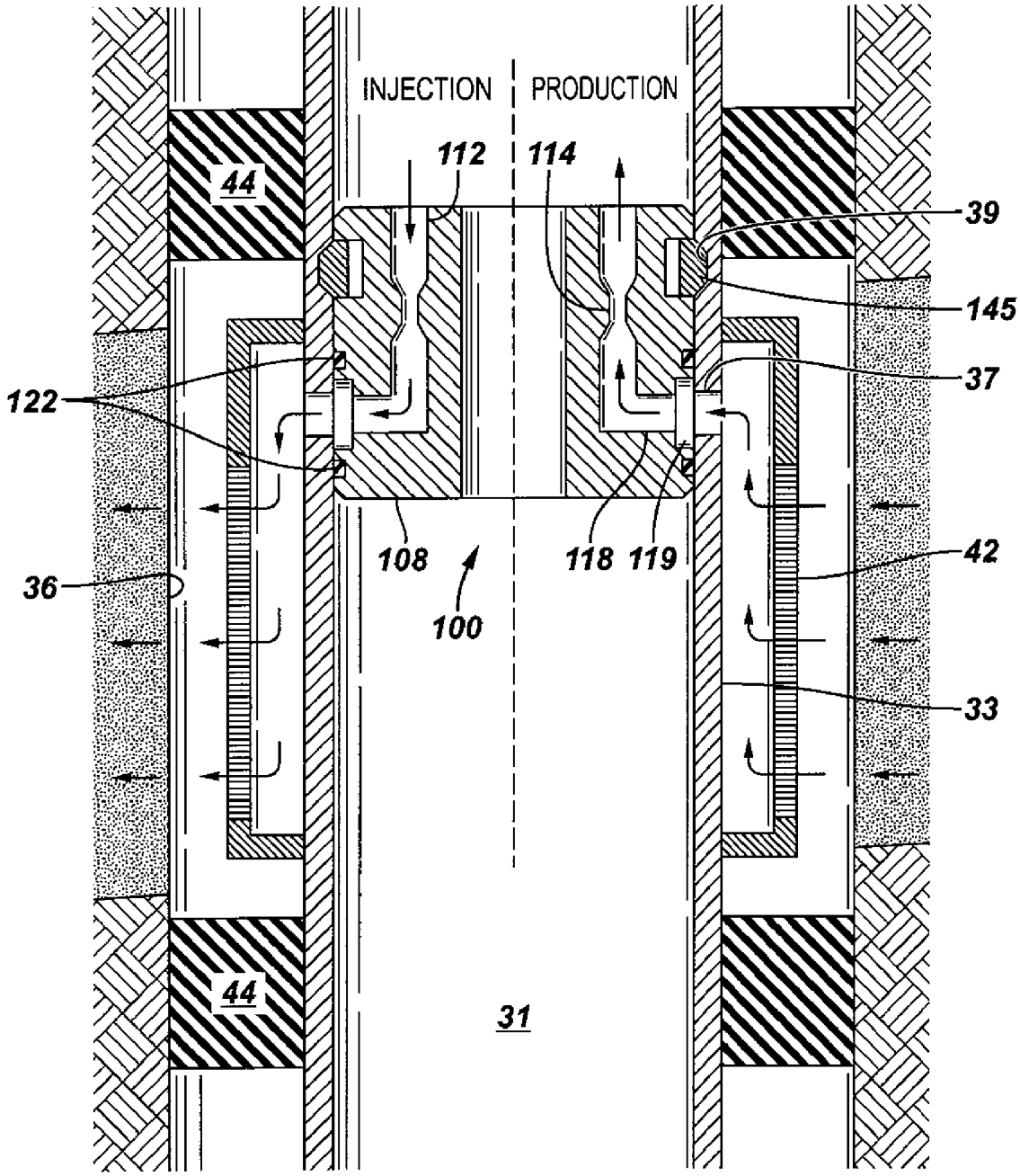
FIG. 3 is a front cross-sectional view of a retrievable flow control device, in accordance with an embodiment of the invention.

FIG. 3 illustrates an exemplary embodiment of a retrievable concentric FCD 100 deployed in an open bore 36 section of a well. FCD 100 may comprise a housing 108 releasably coupled to an interior surface of the screen base pipe 33. A series of first ports 112 may communicate with the interior 31 of the screen base pipe 33. A series of second ports 118 may correspond to the series of first ports 112. The series of second ports 118 may be formed in a concentric ring or groove 119 surrounding the circumference of the concentric FCD 100. The groove 119 allows the individual second ports 118 to fluidly communicate with the tubular ports 37 when the FCD 100 is coupled to the screen base pipe 33. The groove 119 permits the FCD 100 to be at any angular rotation when coupled to the screen base pipe 33. Although the groove 119 is described as a continuous feature circumscribing FCD 100, the groove 119 may be made of discrete features sized and configured to communicate with the tubular ports 37 when FCD 100 is coupled to the screen base pipe 33. In some embodiments, the one or more tubular ports 37 may comprise a plurality of circular orifices spaced at regular intervals about the circumference of the screen base pipe 33. In other embodiments, the groove 119 may be provided in the screen base pipe 33. A choke 114 may be provided in the pathways between each of the first ports 112 and the second ports 118.

The FCD 100 may be coupled with the screen base pipe 33 through the use of engaging protrusions 145. As shown, the engaging protrusions 145 may be configured as one or more split rings, collets, or any of a number of components capable of latchingly engaging the FCD 100 with the screen base pipe 33. The engaging protrusions 145 may be resiliently biased in radially outward direction and configured to slide or translate relatively to the interior surface of the screen base pipe 33 and any upstream production tubing. The engaging protrusions 145 may be configured to fit into a corresponding profile 39 or groove surrounding the interior surface of the screen base pipe 33. Although the engaging protrusions 145 are shown attached to the housing 108 of the FCD 100 and the profile 39 is provided in the screen base pipe 33, it should be understood that the components may be reversed (i.e., the engaging protrusions 145 couple to the screen base pipe 33 and the profile 39 provided on the FCD 100).

The FCD 100 may further comprise two or more seals 122 located above and below the groove 119 containing the second ports 118. The seals 122 may sealingly couple the FCD 100 in a fluid tight manner to the screen base pipe 33 such that the second ports 118 are able to fluidly communicate with the tubular ports 37. The tubular ports 37 may communicate with the surrounding open bore 36 via a screen 42. Further, the fluid communication between the surrounding formation zone and the FCD 100 may be directed through the use of formation isolation devices such as open hole packers 44.

The first ports 112, chokes 114, second ports 118, groove 119, tubular ports 37, and screen 42 may establish a fluid communication pathway between the interior 31 of the screen base pipe 33 and the surrounding formation zone. On the left hand side of the figure, arrows show the direction of fluid flow for an injection process in which the injected fluid travels through the chokes 114 prior to exiting into the surrounding formation zone. The use of the chokes 114 in an injection process may help to control or regulate the injection fluid flow from the interior 31 to the surrounding formation zone. On the right side of the figure, arrows show the direction of fluid flow for controlling production flow from the formation into the interior 31 of the screen base pipe 33. The chokes 114 may help to balance the flow of production fluid from various formation zones. Although the chokes 114 are described separately from the first and second ports 112, 118, the first and second ports 112, 118 or the overall fluid passageways may be configured to act as chokes.

Figure 4:
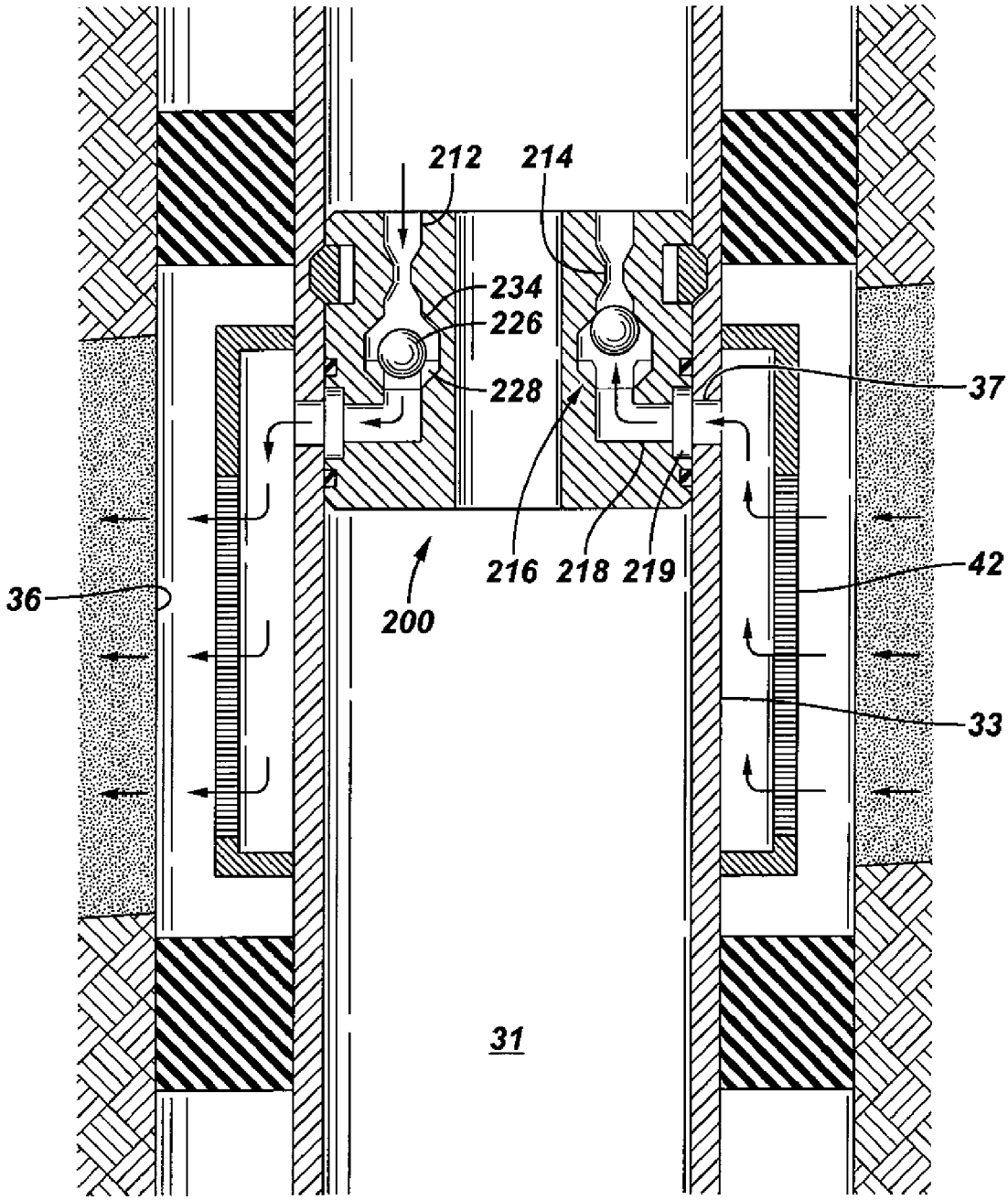
FIG. 4 is a front cross-sectional view of a retrievable flow control device similar to that shown in FIG. 3 but configured with a ball check valve, in accordance with another embodiment of the invention.

Referring now to FIG. 4, a retrievable concentric FCD 200 may be deployed in an open bore 36 of a well. FCD 200 may similar to the previous illustrative embodiment FCD 100 (see FIG. 3), but further comprising a check valve such as a ball check valve 216, for example. The example shown in FIG. 4 is configured to allow fluid to be injected into the surrounding formation zones and to prevent or inhibit back flow from coming out of the formation zones into the interior 31 of the screen base pipe 33. However, it should be understood that FCD 200 could be configured to allow production fluid to flow from the formation zones into the interior 31 of the screen base pipe 33 and to prevent or inhibit flow from the interior 31 out to the surrounding formation zone.

The ball check valve 216 may comprise a ball 226, a sealing surface 234, and protrusions 228. In the inject position, shown on the left side of the figure, the ball 226 rests inside of a cavity on one or more protrusions 228. Injection fluid may flow into the first ports 212 from the interior 31 of the screen base pipe 33. The injection fluid passes through the chokes 214 and enters into a cavity containing the ball 226, forcing the ball 226 downward to rest upon one or more protrusions 228. The protrusions 228 allow the injection fluid to flow around the ball 226 and out of the second ports 218, groove 219, and tubular ports 37. Accordingly, the injection fluid is able to flow from the interior 31 of the screen base pipe 33 and out through the screen 42.

In the back flow or checked position, shown on the right side of the figure, the fluid flows into the screen 42 from the surrounding formation zone, enters into the screen base pipe 33 via the tubular ports 37, and enters into FCD 200 through the groove 219 and second ports 218. The fluid causes the ball 226 to rise to the top of the cavity, against sealing surface 234. The ball 226 forms a fluid tight seal with the sealing surface 234, thereby preventing further fluid flow through FCD 200. As a result, injection operations may take place through FCD 200, but back flow is checked by the ball check valve 216. Although a ball check valve 216 is illustrated in this exemplary embodiment, any type or configuration of check valves may be used, such as for example, a flapper check valve, among others.

Figure 5:
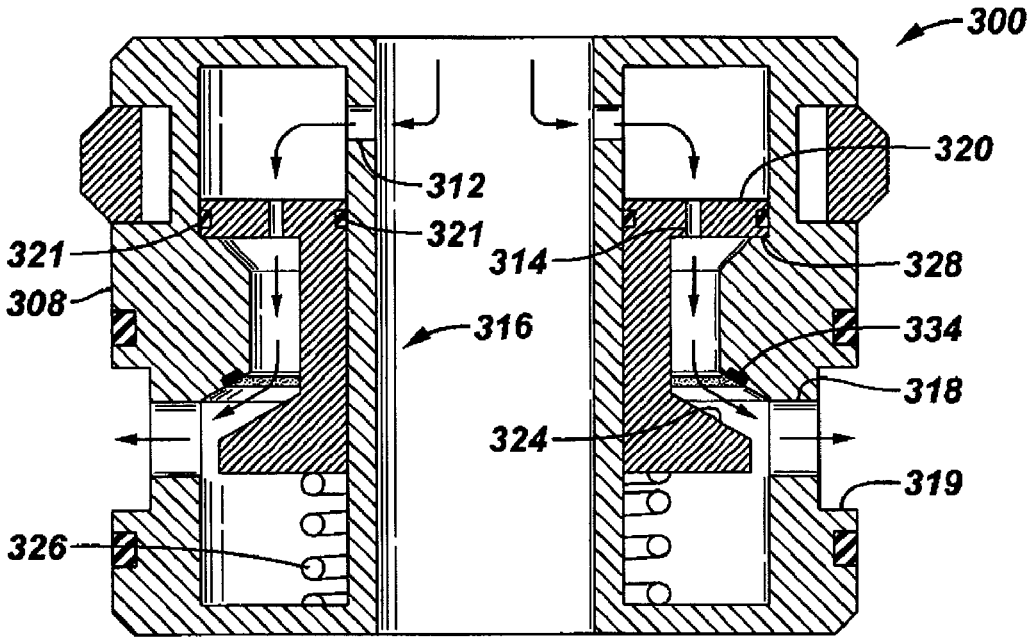
FIG. 5 is a front cross-sectional view of a retrievable flow control device in accordance with another embodiment of the invention.

Turning now to FIG. 5, this drawing illustrates a concentric retrievable flow control device 300 according to another embodiment of the present invention. FCD 300 may include a housing 308, first ports 312, second ports 318, groove 319, and chokes 314. In addition, FCD 300 may include a piston check valve 316 comprising a piston 320 and piston seals 321 to translatably seal the piston 320 to corresponding interior surfaces of the housing 308. The piston 320 may incorporate the one or more chokes 314. In some embodiments, the chokes 314 may be arranged in regular angular intervals about the longitudinal axis of FCD 300. The chokes 314 may establish a fluid pathway between the first ports 312 and the second ports 318 when the piston 320 is in an open position. The chokes 314, first ports 312, and second ports 318 are not required to have equivalent quantities, but embodiments of FCD 300 are not restricted from equivalency.

When injection fluid pressurizes the interior 31 of the screen base pipe 33 (see FIG. 4), the pressurized fluid enters into the housing 308 of the FCD 300 via the first ports 312. Pressure is then exerted upon a surface of the piston 320 (e.g., the top surface as shown in the drawing). The piston seals 321 restrict the fluid from bypassing the chokes 314. As the injection fluid flows through the chokes 314, a pressure is exerted on the top surface of the piston 320. When the pressure on the top surface of the piston 320 exceeds a bias in the opposing direction created by a resilient member 326, the piston 320 is urged in a downward direction. The piston 320 then translates in a longitudinal direction, disengaging a sealing surface 324 from a seal 334, and creating a fluid pathway to second ports 318. The injection fluid is then able to enter groove 319 for distribution to the well bore surrounding FCD 300 (via tubular ports 37, see FIG. 4). In some embodiments, the piston 320 may be limited in downward travel by a protrusion 328 provided in the housing 308. FCD 300 is illustrated in an open position during an injection operation.

When the pressure exerted on one side of the piston 324 falls below the force exerted by resilient member 326, the piston 324 translates in a longitudinal direction upward. Then the sealing surface 324 engages the seal 334, closing or inhibiting passage of fluid through the first and second ports 312, 318. Back flow through FCD 300 is effectively checked by the action of the piston 324 and the sealing surface 324 engaging the seal 334. As with previous embodiments, although the check valve 316 is shown as configured for blocking back flow into the interior 31 of the screen base pipe 33 (see FIG. 4), embodiments of the current invention are not limited to this configuration. The piston 320 may be configured to allow production fluid to flow into the screen base pipe 33 and check the flow of fluid to the area outside of FCD 300.

In the embodiment shown, the resilient member 326 is illustrated by a mechanical spring, such as a coil spring for example. However, the resilient member 326 may not be limited to this one example. Gas or pressure devices such as springs, solid resilient materials, and other forms of resiliently deformable devices without limitation may be used for the resilient member 326.

Figure 6:
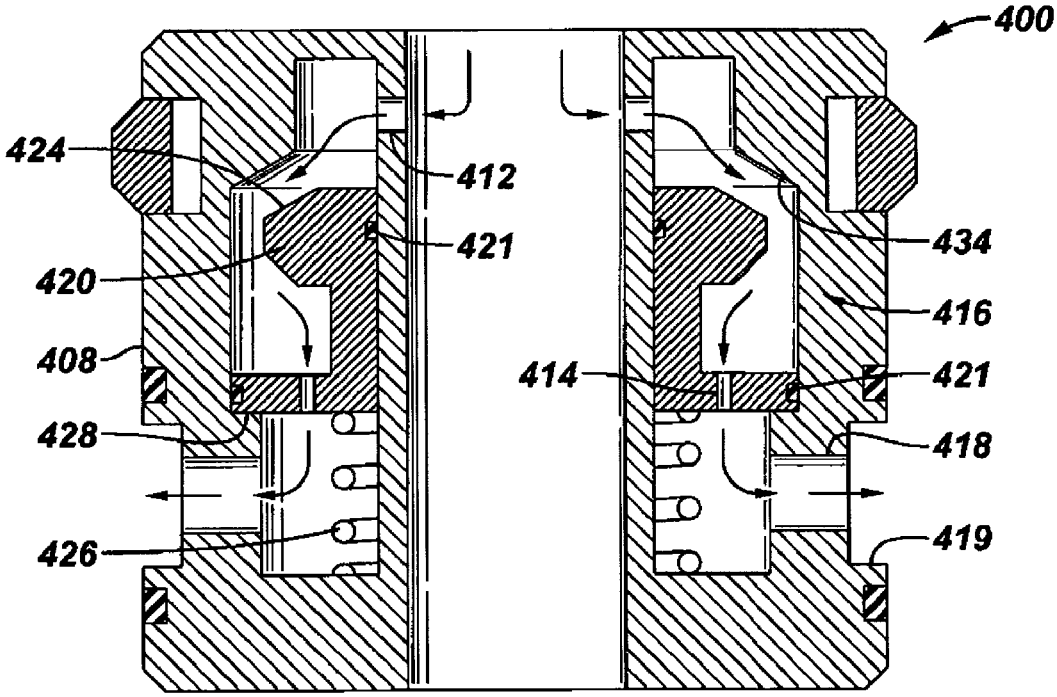
FIG. 6 is a front cross-sectional view of a retrievable flow control device in accordance with another embodiment of the invention.

Referring now to FIG. 6, this drawing illustrates a concentric flow control device 400 according to another embodiment of the present invention. FCD 400 may include a housing 408, first ports 412, second ports 418, groove 419, and chokes 414. In addition, FCD 400 may include a piston check valve 416 comprising a piston 420 and piston seals 421 to translatably seal the piston 420 to corresponding interior surfaces of the housing 408. The piston 420 may incorporate the one or more chokes 414. In some embodiments, the chokes 414 may be arranged in regular angular intervals about the longitudinal axis of FCD 400. The chokes 414 may establish a fluid pathway between the first ports 412 and the second ports 418 when the piston 420 is in an open position. The chokes 414, first ports 412, and second ports 418 are not required to have equivalent quantities, but embodiments of FCD 400 are not restricted from equivalency.

When injection fluid pressurizes the interior 31 of the screen base pipe 33 (see FIG. 4), the pressurized fluid enters into the housing 408 of FCD 400 via the first ports 412. Pressure is then exerted upon a surface of the piston 420 (e.g., a top surface as shown in the drawing). The piston seals 421 restrict the fluid from bypassing the chokes 414. As the injection fluid flows through the chokes 414, a pressure is exerted on the top surface of the piston 420. When the pressure on the top surface of the piston 420 exceeds a bias in the opposing direction created by a resilient member 426, the piston 420 is urged in a downward direction. The piston 420 then translates in a longitudinal direction, disengaging a piston sealing surface 424 from a housing sealing surface 434, and creating a fluid pathway to second ports 418. The injection fluid is then able to enter groove 419 for distribution to the well bore surrounding FCD 400 (via tubular ports 37, see FIG. 4). In some embodiments, the piston 420 may be limited in downward travel by a protrusion 428 provided in the housing 408. FCD 400 is illustrated in an open position during an injection operation.

When the pressure exerted on one side of the piston 420 falls below the force exerted by resilient member 426, the piston 420 translates in a longitudinal direction upward. Then the piston sealing surface 424 engages the housing sealing surface 434, closing or inhibiting passage of fluid through the first and second ports 412, 418. Back flow through FCD 400 is effectively checked by the action of the piston 420 and the piston sealing surface 424 engaging the housing sealing surface 434. As with previous embodiments, although the check valve 416 is shown as configured for blocking back flow into the interior 31 of the screen base pipe 33 (see FIG. 4), embodiments of the current invention are not limited to this configuration. The piston 420 may be configured to allow production fluid to flow into the screen base pipe 33 and check the flow of fluid in the opposite direction to the area outside of FCD 400.

Figure 7:
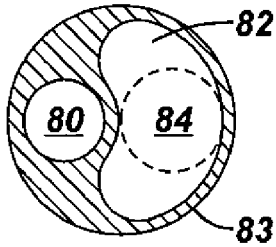
FIG. 7 is a top cross-sectional view of a screen base pipe comprising a side pocket mandrel.

Turning now to FIG. 7, in some embodiments of the present invention, a retrievable FCD will be provided in a side pocket 80 of a base pipe 86. The base pipe 83 may be configured for use as a screen base pipe 33 (see FIG. 4). The base pipe 83 may comprise two longitudinal bores, a main bore 82 and a side pocket 80. The main bore 82 may provide access (indicated by broken line 84) for running through tubing tools such as logging tools, for example. In addition, fluid flow such as injection fluid and production fluid may pass through the main bore 82 of the base pipe 83.

Figure 8:
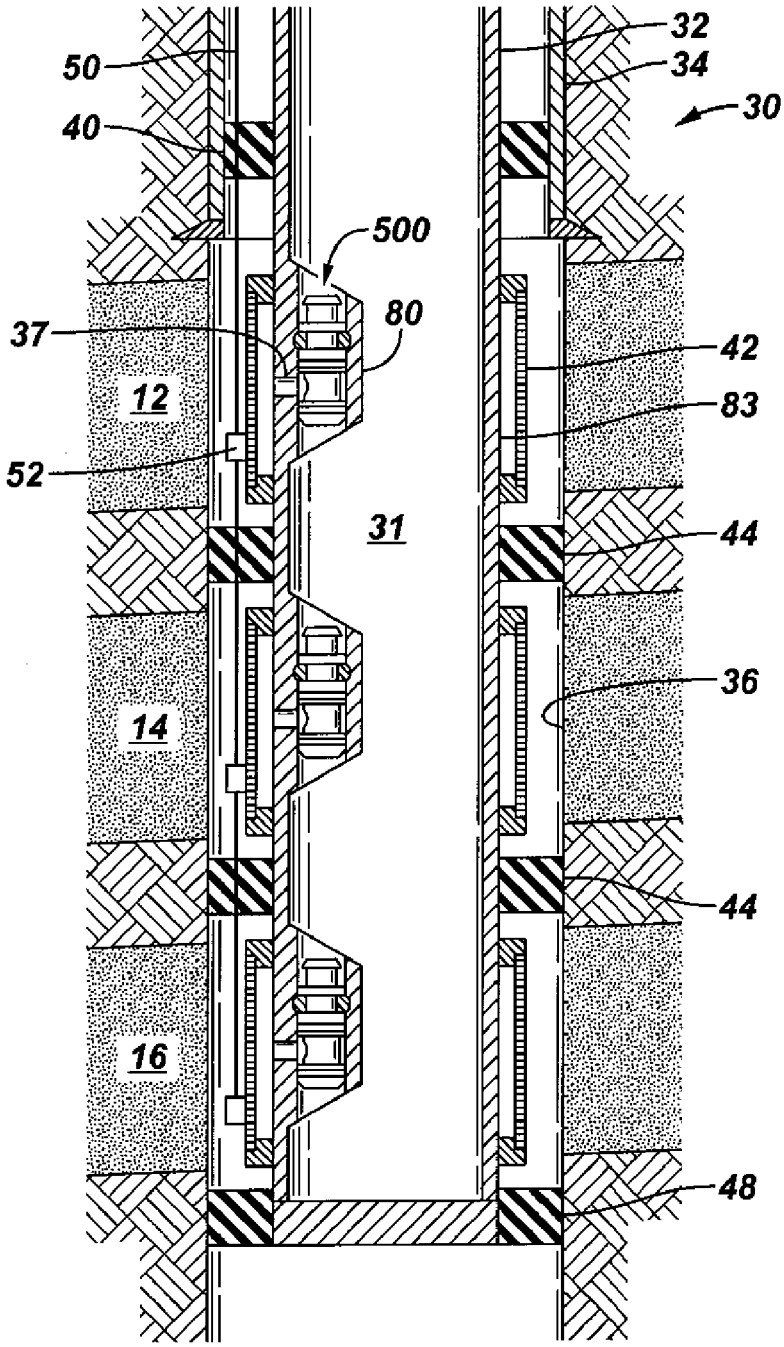
FIG. 8 is a front cross-sectional view of a retrievable flow control device run on an inner tubing string inside of a sand screen, in accordance with another embodiment of the invention.

Referring generally to FIG. 8, this drawing shows an enlarged detail view of an illustrative example of a completion 30 comprising one or more retrievable FCDs 500 (three are shown in this example). The completion 30 may be run along with the production tubing 32. At the end of the casing 34, a screen hanger packer 40 may couple and support the completion 30 in the open bore 36, as well as seal the interior of the casing 34 from the open hole formation zones 12, 14, and 16. The interior 31 of the completion 30 may be further sealed from the open wellbore by an end of tubing device 48. The FCDs 500 may control fluid flow between the interior 31 of the completion 30 and the surrounding formation zones 12, 14, and 16, via tubular ports 37.

In some cases, completion 30 may comprise a screen base pipe 83. Screen base pipe 83 may be configured to removably support the retrievable FCDs 500 in one or more side pockets 80, as well as support one or more screens 42, depending upon the type and application of the well 20 (see FIG. 1). The screens 42 may be configured to filter out contaminants such as sand from entering into the interior 31 of the completion 30. In some cases, expandable sand screens may be used for screens 42. The screens 42 may be separated into sections for the corresponding formation zones 12, 14, and 16 by open bore isolation packers 44.

Completion 30 may further comprise a sensor bridal 50 including one or more sensors 52. The sensors 52 may be for monitoring physical parameters of the well, such as flow rate, temperature, and resistivity, among others. The sensor bridal 50 may also be used to control intelligent completion devices (not shown) and establish a communication pathway between the surface 28 (FIG. 1) and the interior of the well. As shown in FIG. 2, three sensors 52 may be provided to monitor conditions for each of the formation zones 12, 14, and 16. However, the sensors 52 may be incorporated into the sensor bridal 50. For example, the sensor bridal 50 may comprise a fiber optic cable, thereby permitting the establishment of a distributed temperature system configured to determine temperatures throughout the length of the well.

Figure 9:
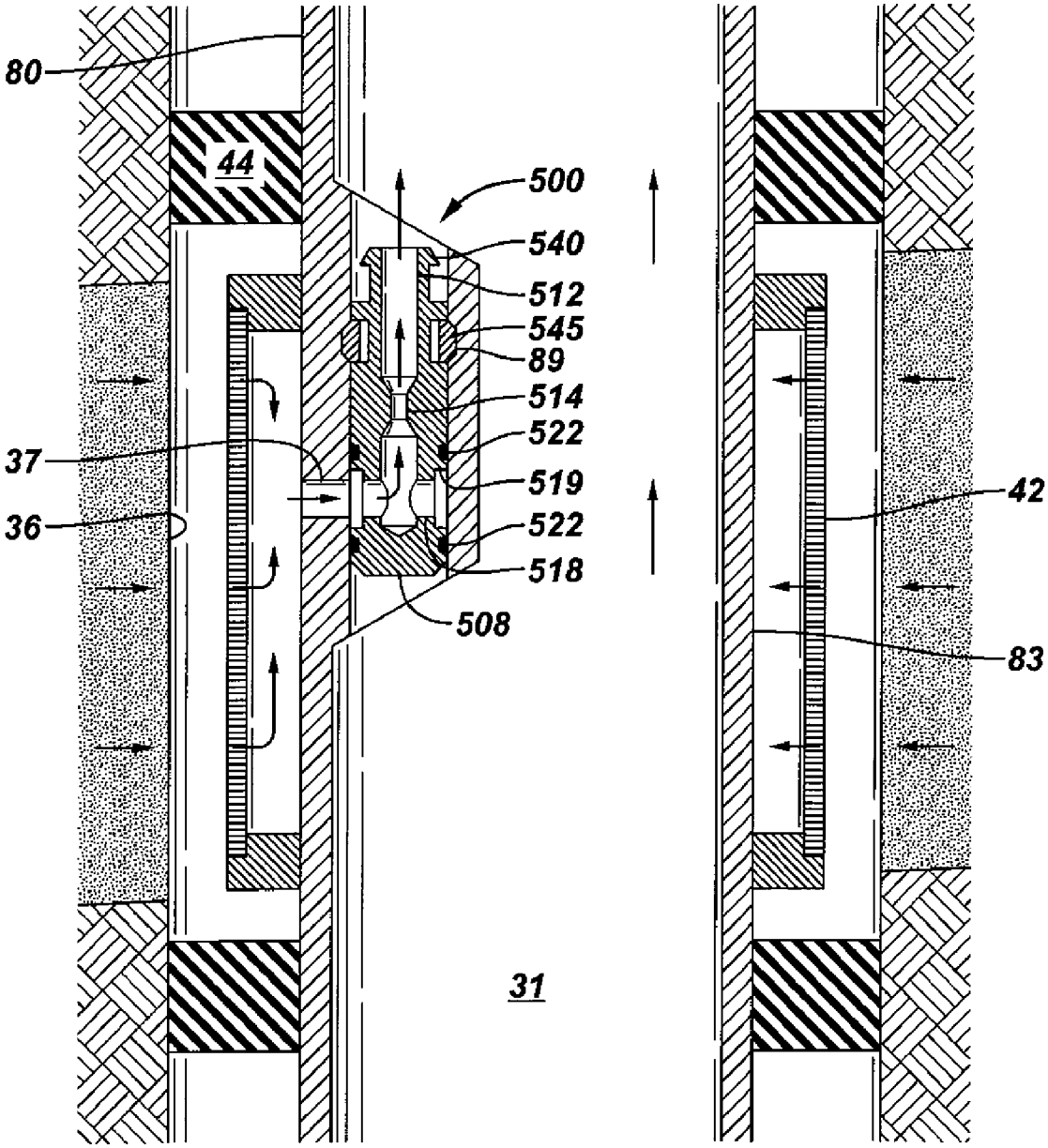
FIG. 9 is a front cross-sectional view of a retrievable flow control device in accordance with another embodiment of the invention.

Turning now to FIG. 9, this drawing illustrates an exemplary embodiment of a retrievable side pocket FCD 500 deployed in an open bore 36 section of a well. FCD 500 may comprise a housing 508 releasably coupled to an interior surface of the side pocket 80. A first port 512 may communicate with the interior 31 of the screen base pipe 83. A series of second ports 518 may fluidly communicate with the first port 512. The series of second ports 518 may be formed in a concentric ring or groove 519 surrounding the circumference of the side pocket FCD 500. The groove 519 allows the individual second ports 518 to fluidly communicate with the tubular port 37 when the FCD 500 is coupled to the side pocket 80. The groove 519 permits the FCD 500 to be at any angular rotation when coupled to the side pocket 80. Although the groove 519 is described as a continuous feature circumscribing FCD 500, the groove 519 may be made of discrete features sized and configured to communicate with the tubular ports 37 when FCD 500 is coupled to the side pocket 80. In some embodiments, the groove 519 may be provided in the side pocket 80. A choke 514 may be provided in the pathways between the first port 512 and the second ports 518. The housing 508 further comprises a coupling device 540. The coupling device 540 may be configured to releasably engage with a tool (not shown) for retrieval or insertion of FCD 500. In some embodiments, the coupling device 540 is located surrounding the first port 512, however, other embodiments of the present invention may not be limited to this configuration.

The FCD 500 may be coupled with the side pocket 80 through the use of engaging protrusions 545. As shown, the engaging protrusions 545 may be configured as one or more split rings, collets, or any of a number of components capable of latchingly engaging the FCD 500 with a corresponding profile 89 provided in the interior of the side pocket 80. The engaging protrusions 545 may be resiliently biased in radially outward direction and configured to slide or translate relatively to the interior surface of the side pocket 80. Although the engaging protrusions 545 are shown as attached to the housing 508 of the FCD 500 and the profile 89 is shown as provided in the side pocket 80, it should be understood that the locations of the components may be reversed (i.e., the engaging protrusions 545 may be coupled to the side pocket 80 and the profile 89 may be provided about the FCD 500).

The FCD 500 may further comprise two or more seals 522 located above and below the groove 519 containing the second ports 518. The seals 522 may sealingly couple the FCD 500 in a fluid tight manner to the side pocket 80 such that the second ports 518 are able to fluidly communicate with the tubular port 37. The tubular port 37 may communicate with the surrounding open bore 36 via a screen 42. Further, the fluid communication between the surrounding formation zone and the FCD 500 may be directed through the use of formation isolation devices such as open hole packers 44.

The first port 512, choke 514, second ports 518, groove 519, tubular port 37, and screen 42 may establish a fluid communication pathway between the interior 31 of the screen base pipe 83 and the surrounding formation zone. The arrows show the direction of production fluid flow into the interior 31 of the screen base pipe 83. However, FCD 500 may also be used for controlling an injection process in which injection fluid is transmitted from the interior 31 of the screen base pipe 83 to the surrounding formation zone.

Figure 10:
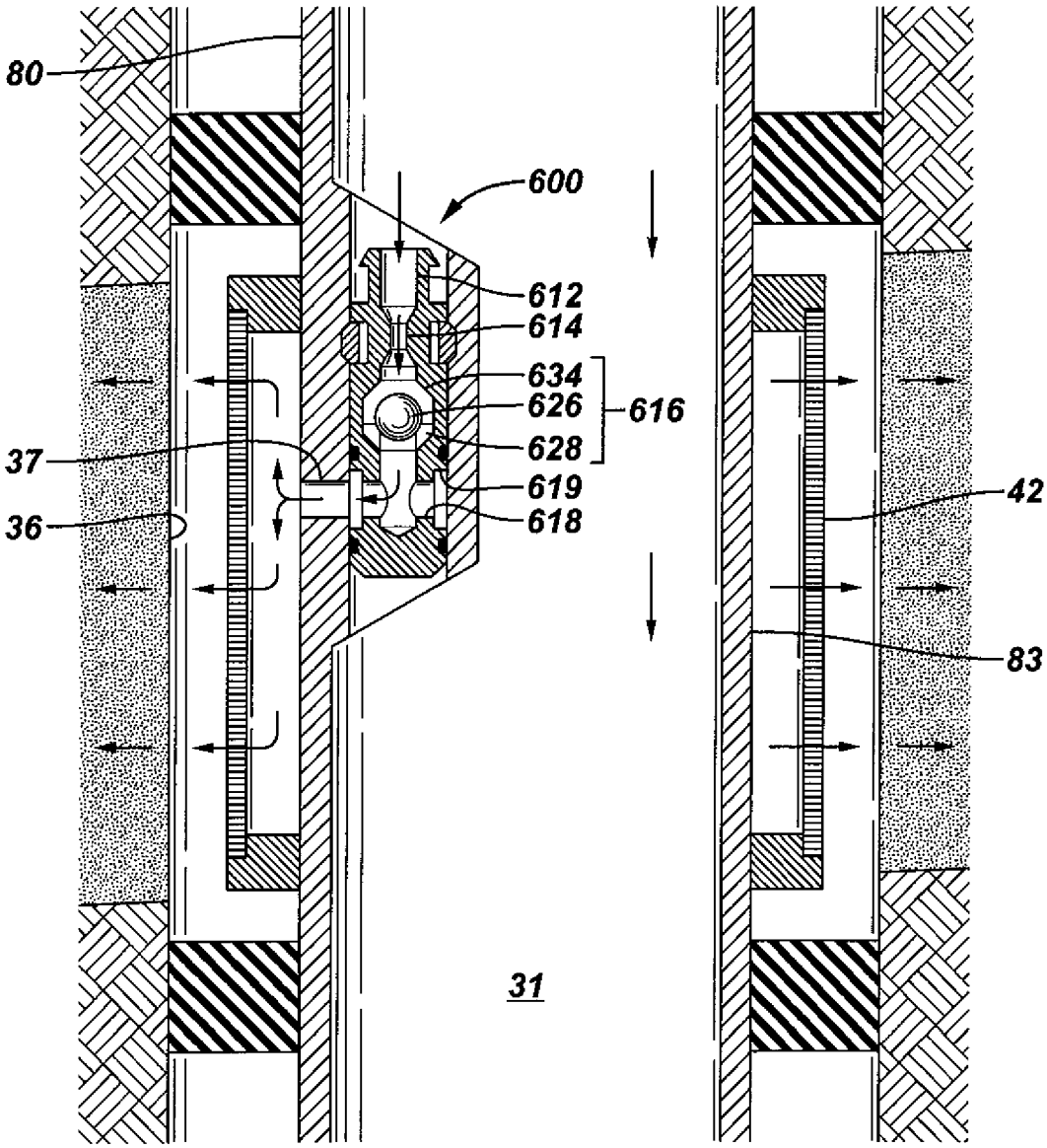
FIG. 10 is a front cross-sectional view of a retrievable flow control device similar to that shown in FIG. 9 but configured with a ball check valve, in accordance with another embodiment of the invention.

Referring now to FIG. 10, a retrievable FCD 600 may be deployed in an open bore 36 of a well. FCD 600 may similar to the previous illustrative embodiment FCD 500 (see FIG. 9), but further comprising a check valve such as a ball check valve 616, for example. The example shown in FIG. 10 is configured to allow fluid to be injected into the surrounding formation zones and to prevent or inhibit back flow from coming out of the formation zones into the interior 31 of the screen base pipe 83. However, it should be understood that FCD 600 could be configured to allow production fluid to flow from the formation zones into the interior 31 of the screen base pipe 83 and to prevent or inhibit flow from the interior 31 out to the surrounding formation zone.

The ball check valve 616 may comprise a ball 626, a sealing surface 634, and protrusions 628. In the inject position shown in the figure, the ball 626 rests inside of a cavity on one or more protrusions 628. Injection fluid may flow into the first port 612 from the interior 31 of the screen base pipe 83. The injection fluid passes through the choke 614 and enters into a cavity containing the ball 626, forcing the ball 626 downward to rest upon one or more protrusions 628. The protrusions 628 allow the injection fluid to flow around the ball 626 and out of the second ports 618, groove 619, and tubular port 37. Accordingly, the injection fluid is able to flow from the interior 31 of the screen base pipe 83 and out through the screen 42.

In the back flow or checked position (not shown), the fluid flows into the screen 42 from the surrounding formation zone, enters into the screen base pipe 83 via the tubular port 37, and enters into FCD 600 through the groove 619 and second ports 618. The fluid causes the ball 626 to rise to the top of the cavity, against sealing surface 634. The ball 626 forms a fluid tight seal with the sealing surface 634, thereby preventing further fluid flow through FCD 600. As a result, injection operations may take place through FCD 600, but back flow is checked by the ball check valve 616. Although a ball check valve 616 is illustrated in this exemplary embodiment, any type or configuration of check valves may be used, such as for example, a flapper check valve, among others.

Figure 11:
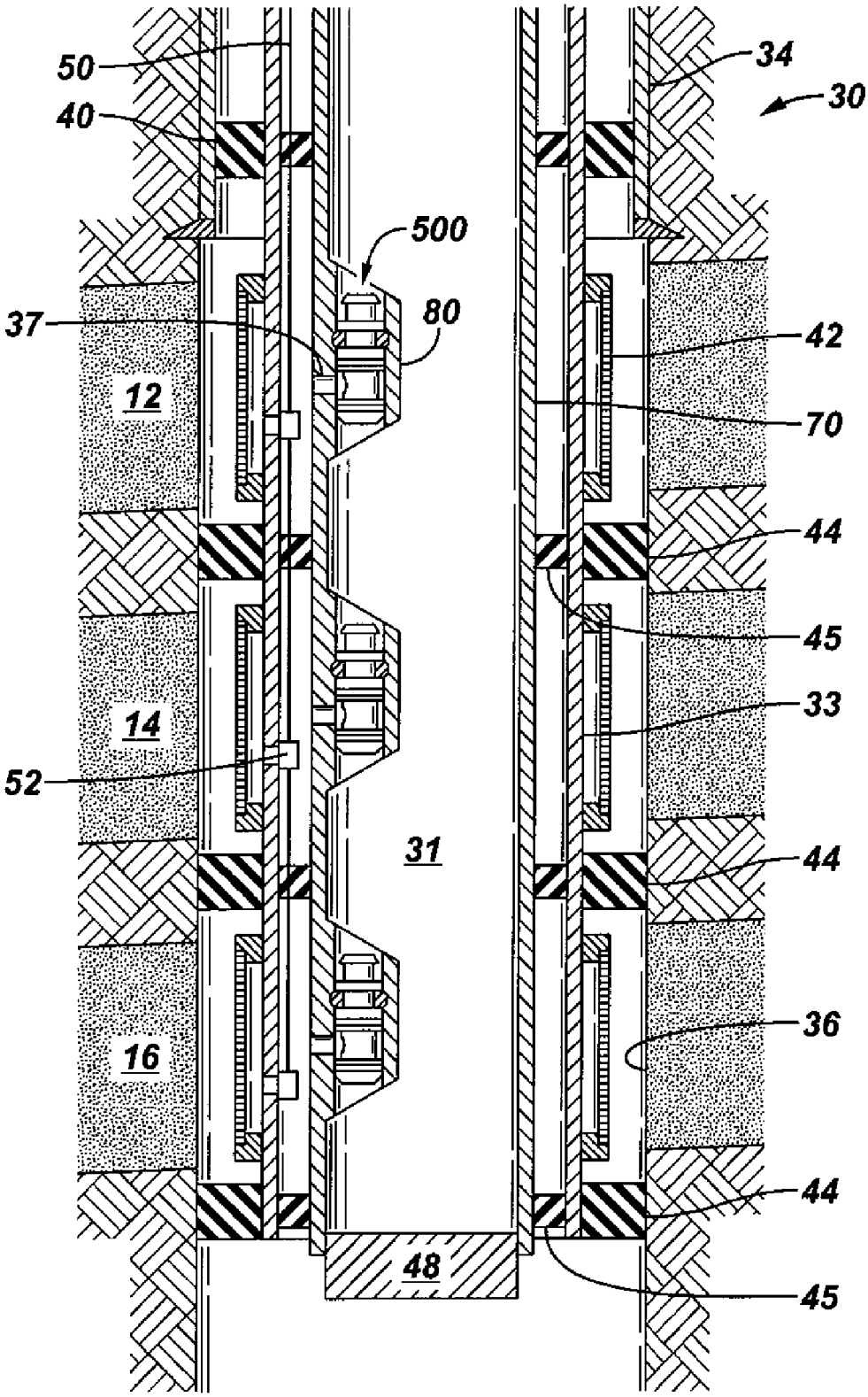
FIG. 11 is a front cross-sectional view of a retrievable flow control device run on a stinger inside of a sand screen, in accordance with another embodiment of the invention.

Referring generally to FIG. 11, this drawing shows an enlarged detail view of an illustrative example of a completion 30 comprising one or more retrievable FCDs 500 (three are shown in this example) run into the completion 30 via a stinger 70. At the end of the casing 34, a screen hanger packer 40 may couple and support the completion 30 in the open bore 36, as well as seat the interior of the casing 34 from the open hole formation zones 12, 14, and 16. In some cases, completion 30 may comprise a screen base pipe 33. Screen base pipe 33 may be configured to support one or more screens 42, depending upon the type and application of the well 20 (see FIG. 1). The screens 42 may be configured to filter out contaminants such as sand from entering into the interior 31 of the completion 30. In some cases, expandable sand screens may be used for screens 42. The screens 42 may be separated into sections for the corresponding formation zones 12, 14, and 16 by open bore isolation packers 44.

Completion 30 may further comprise a sensor bridal 50 including one or more sensors 52. The sensors 52 may be for monitoring physical parameters of the well, such as flow rate, temperature, and resistivity, among others. The sensor bridal 50 may also be used to control intelligent completion devices (not shown) and establish a communication pathway between the surface 28 (FIG. 1) and the interior of the well. As shown in FIG. 2, three sensors 52 may be provided to monitor conditions for each of the formation zones 12, 14, and 16. However, the sensors 52 may be incorporated into the sensor bridal 50. For example, the sensor bridal 50 may comprise a fiber optic cable, thereby permitting the establishment of a distributed temperature system configured to determine temperatures throughout the length of the well.

The stinger 70 may comprise intermediate components 45. The intermediate components 45 may be isolation seal assemblies, packers, or cup packers, configured to couple the stinger 70 to the interior surface of the screen base pipe 33 or a seal bore. The intermediate components 45 may further configure the interface between the screen base pipe 33 and the stinger 70 into sections corresponding to the surrounding formation zones 12, 14, and 16. The stinger 70 may also comprise side pockets 80 configured to receive the retrievable FCDs 500.

Figure 12:
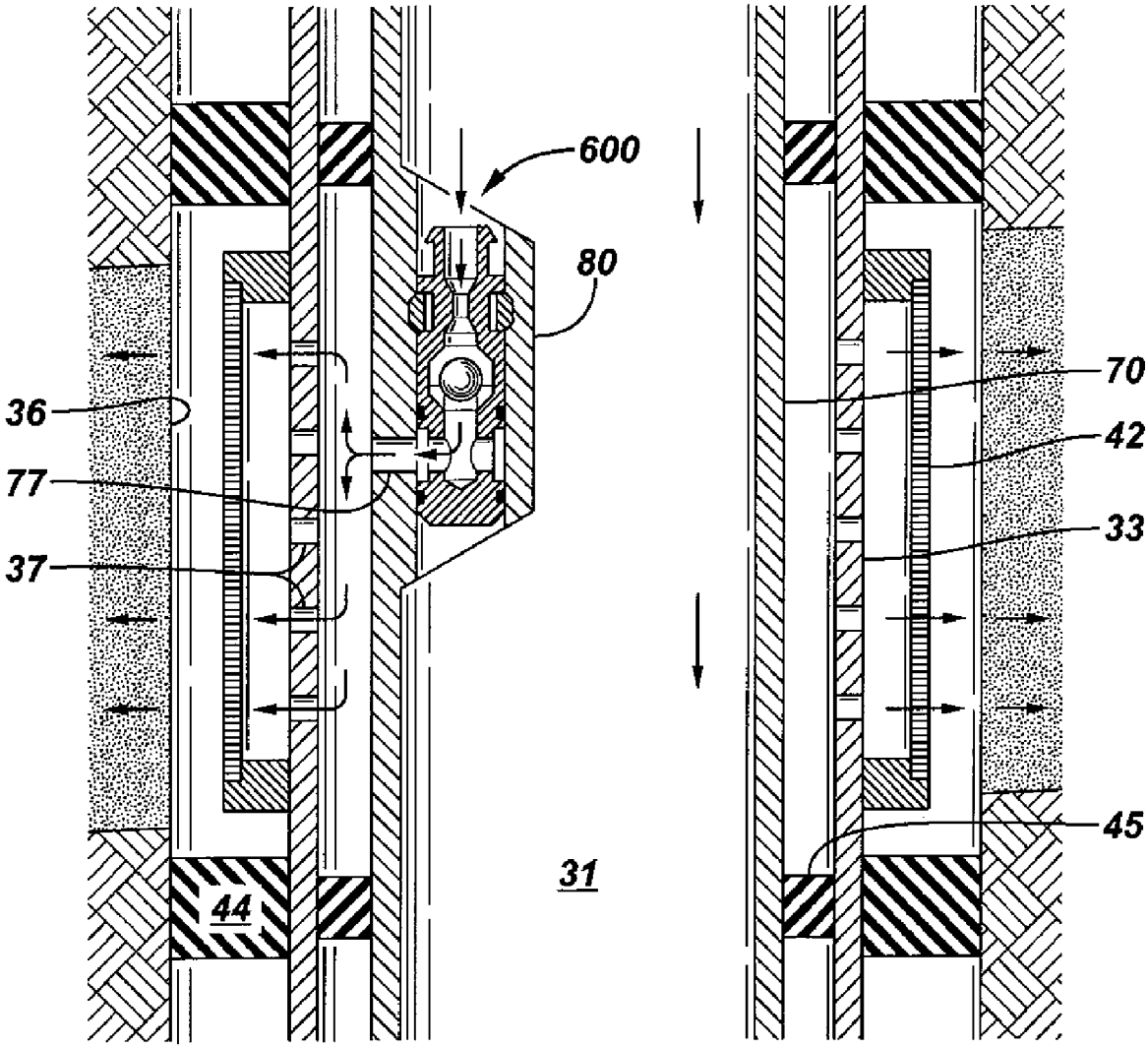
FIG. 12 is a front cross-sectional view of a retrievable flow control device in accordance with another embodiment of the invention.

Referring now to FIG. 12, a retrievable FCD 600 may be deployed on a stinger 70 in an open bore 36 of a well. The retrievable FCD 600 was previously described and will not be repeated for this exemplary embodiment. Stinger 70 may comprise a side pocket 80 configured to accommodate and receive the FCD 600. The stinger 70 may be inserted into the lower completion 30 and aligned with tubular ports 37 provide in the screen base pipe 33. The tubular ports 37 may be proximate to screens 42. The screens 42 may be configured to filter out contaminants such as sand from entering into the interior 31 of the completion 30. In some cases, expandable sand screens may be used for screens 42.

The stinger 70 may be coupled to the screen base pipe 33 via intermediate components 45. The intermediate components 45 and open hole packers 44 may direct fluid (e.g., injection fluid, production fluid, among others), to a stinger port 77 provided in the stinger 70. FCD 600 controls the ingress or egress of fluid via the stinger port 77 as in the previous embodiment (the arrows depict the flow of an injection process in the drawing).

Figure 13:
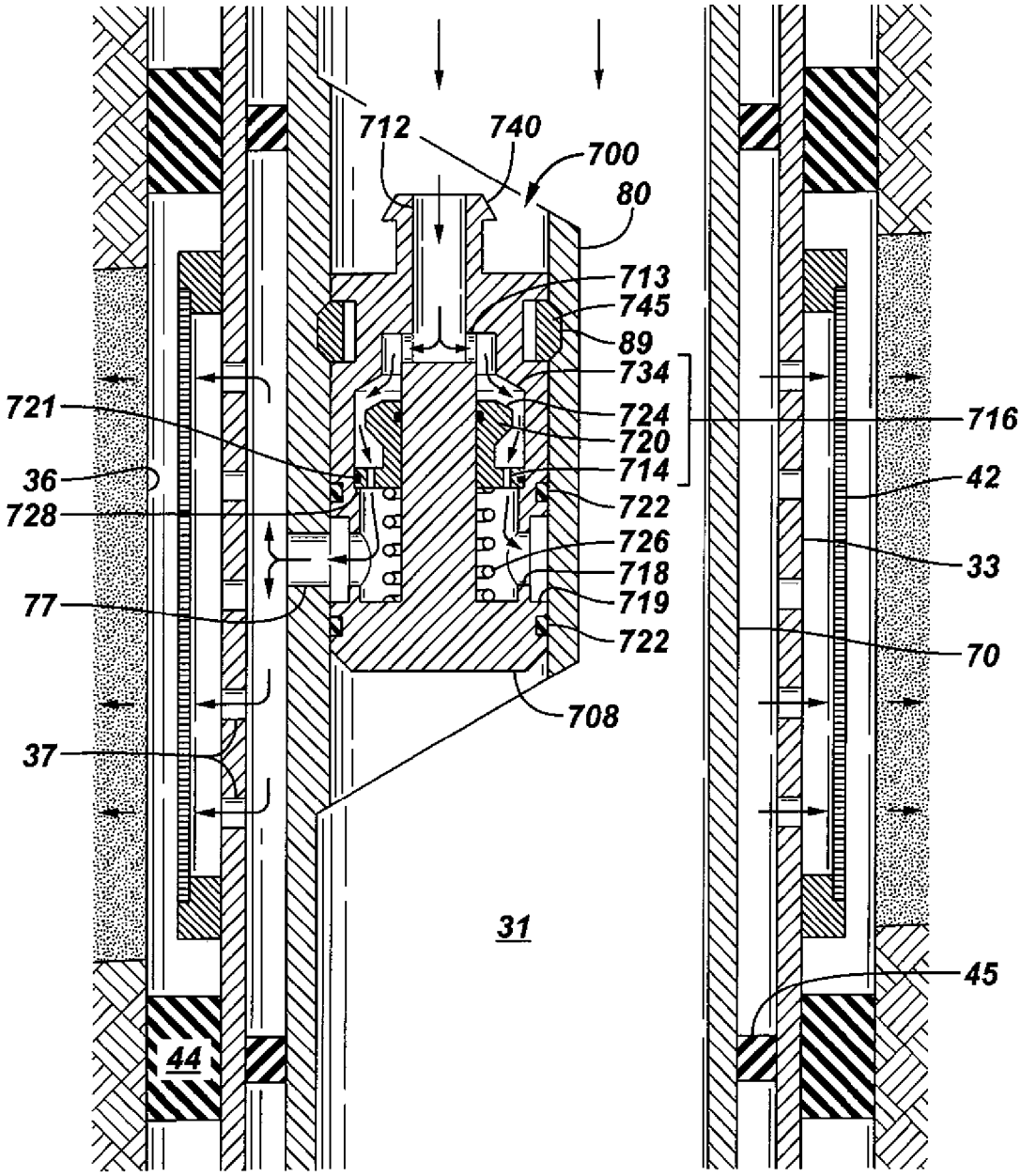
FIG. 13 is a front cross-sectional view of a retrievable flow control device in accordance with another embodiment of the invention.

Turning now to FIG. 13, this drawing illustrates an exemplary embodiment of a retrievable side pocket FCD 700 deployed in an open bore 36 section of a well. FCD 700 may comprise a housing 708 releasably coupled to an interior surface of the side pocket 80. A first port 712 may communicate with the interior 31 of the stinger 70. A series of first internal ports 713 may fluidly communicate with the first port 712. A corresponding series of second ports 718 may fluidly communicate with the series of first internal ports 713 when a check valve 716 is in an opened position. The series of second ports 718 may be formed in a concentric ring or groove 719 surrounding the circumference of the side pocket FCD 700. The groove 719 allows the individual second ports 718 to fluidly communicate with the stinger port 77 when the FCD 700 is coupled to the side pocket 80. The groove 719 permits the FCD 700 to be at any angular rotation when coupled to the side pocket 80. Although the groove 719 is described as a continuous feature circumscribing FCD 700, the groove 719 may be made of discrete features sized and configured to communicate with the stinger port 77 when FCD 700 is coupled to the side pocket 80. In some embodiments, the groove 719 may be provided in the side pocket 80.

The housing 708 further comprises a coupling device 740. The coupling device 740 may be configured to releasably engage with a tool (not shown) for retrieval or insertion of FCD 700. In some embodiments, the coupling device 740 is located surrounding the first port 712, however, other embodiments of the present invention may not be limited to this configuration. The FCD 700 may be coupled with the side pocket 80 through the use of engaging protrusions 745. As shown, the engaging protrusions 745 may be configured as one or more split rings, collets, or any of a number of components capable of latchingly engaging the FCD 700 with a corresponding profile 89 provided in the interior of the side pocket 80. The engaging protrusions 745 may be resiliently biased in radially outward direction and configured to slide or translate relatively to the interior surface of the side pocket 80. Although the engaging protrusions 745 are shown as attached to the housing 708 of the FCD 700 and the profile 89 is shown as provided in the side pocket 80, it should be understood that the locations of the components may be reversed (i.e., the engaging protrusions 745 may be coupled to the side pocket 80 and the profile 89 may be provided about the FCD 700).

The housing 708 may further comprise two or more seals 722 located above and below the groove 719 containing the second ports 718. The seals 722 may sealingly couple the FCD 700 in a fluid tight manner to the side pocket 80 such that the second ports 718 are able to fluidly communicate with the stinger port 77. The stinger port 77 may communicate with the surrounding open bore 36 via tubular ports 37 and a screen 42. Further, the fluid communication between the surrounding formation zone and the FCD 700 may be directed through the use of formation isolation devices such as open hole packers 44.

In addition, FCD 700 may include a piston check valve 716 comprising a piston 720 and piston seals 721 to translatably seal the piston 720 to corresponding interior surfaces of the housing 708. The piston 720 may incorporate the one or more chokes 714. In some embodiments, the chokes 714 may be arranged in regular angular intervals about the longitudinal axis of FCD 700. The chokes 714 may establish a fluid pathway between the first port 712, first internal ports 713, and the second ports 718 when the piston 720 is in an open position. The chokes 714, first internal ports 713, and second ports 718 are not required to have equivalent quantities, but embodiments of FCD 700 are not restricted from equivalency.

When injection fluid pressurizes the interior 31 of the stinger 70, the pressurized fluid enters into the housing 708 of FCD 700 via the first port 712 and the first internal ports 713. Pressure is then exerted upon a surface of the piston 720 (e.g., a top surface as shown in the drawing). The piston seals 721 restrict the fluid from bypassing the chokes 714. As the injection fluid flows through the chokes 714, a pressure is exerted on the top surface of the piston 720. When the pressure on the top surface of the piston 720 exceeds a bias in the opposing direction created by a resilient member 726, the piston 720 is urged in a downward direction. The piston 720 then translates in a longitudinal direction, disengaging a piston sealing surface 724 from a housing sealing surface 734, and creating a fluid pathway to second ports 718. The injection fluid is then able to enter groove 719 for distribution to the well bore surrounding FCD 700 (via stinger port 77 and tubular ports 37). In some embodiments, the piston 720 may be limited in downward travel by a protrusion 728 provided in the housing 708. FCD 700 is illustrated in an open position during an injection operation.

When the pressure exerted on one side of the piston 720 falls below the force exerted by resilient member 726, the piston 720 translates in a longitudinal direction upward. Then the piston sealing surface 724 engages the housing sealing surface 734, closing or inhibiting passage of fluid through the first internal and second ports 713, 718. Back flow through FCD 700 is effectively checked by the action of the piston 720 and the piston sealing surface 724 engaging the housing sealing surface 734. As with previous embodiments, although the check valve 716 is shown as configured for blocking back flow into the interior 31 of the stinger 70, embodiments of the current invention are not limited to this configuration. The piston 720 may be configured to allow production fluid to flow into the screen base pipe 33 and check the flow of fluid in the opposite direction to the area outside of FCD 700.

Figure 14:
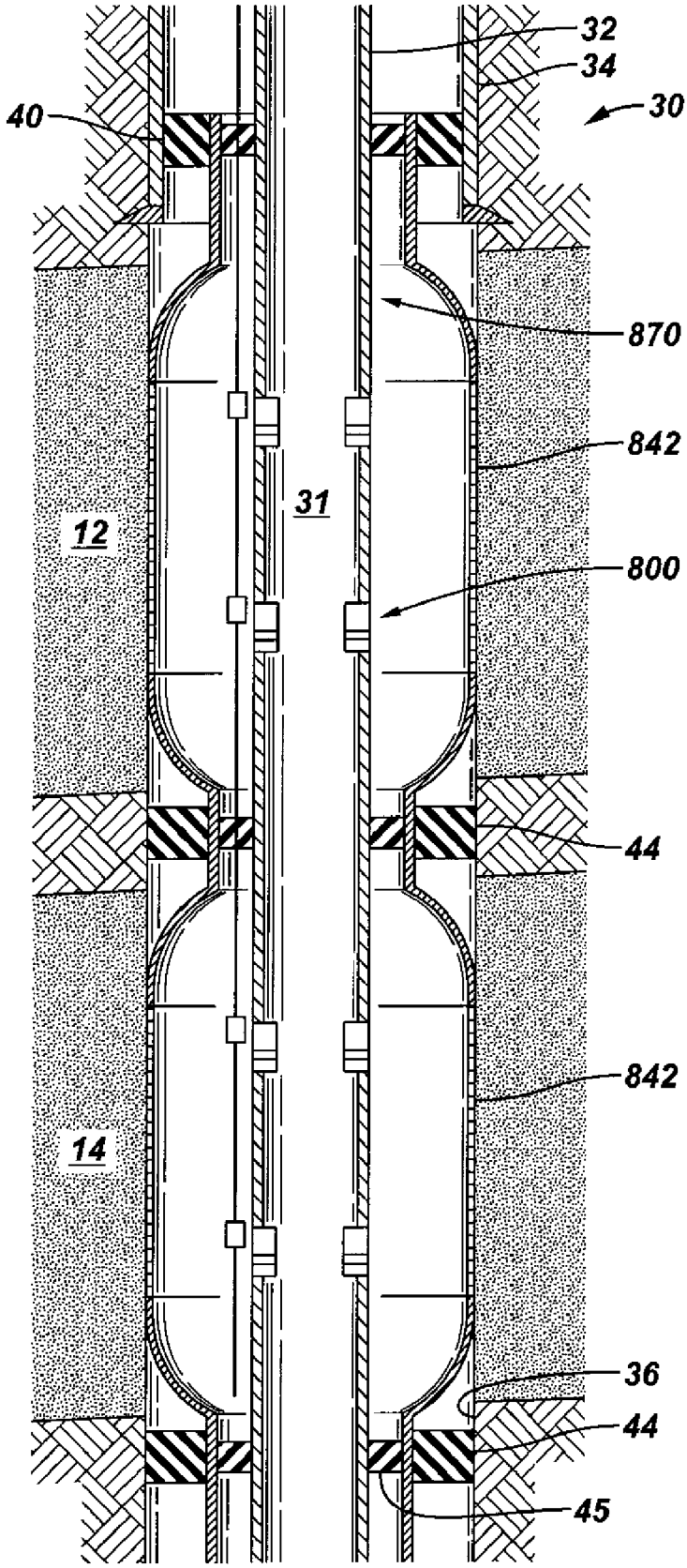
FIG. 14 is a front cross-sectional view of a retrievable flow control device in accordance with another embodiment of the invention.

Referring now to FIG. 14, this illustration shows an exemplary completion 30 with one or more FCDs 800 (four are shown in this drawing) coupled to a stinger 870 located inside of an expandable screen 842. The expandable screen 842 may be coupled with the casing 34 through the use of screen hanger packers 40. The expandable screen 842 may extend below the casing 34 into the open bore 36. In this illustrative embodiment, the expandable screen 842 may be sectioned through the use of two open hole packers 44 in order to correspond to the two formation zones 12 and 14. Intermediate components 45, such as seal assemblies, packers, or cup packers, among others, may be configured to couple the stinger 870 to the interior surface of the expandable screen 842 or a seal bore.

In the embodiment shown the FCDs 800 are run on the stinger 870 inside of the expandable screen 842. For example, the stinger 870 may be attached to the upper completion, shown by production tubing 32, and run along with the upper completion. The FCDs 800 may be retrieved to surface when the stinger 870 is retrieved to the surface along with the upper completion. In an alternate embodiment (not shown) the stinger 870, along with the FCDs 800, may be initially deployed inside the expandable screen 842 prior to running the upper completion. The upper completion may then be run in the hole. In yet another alternate embodiment (not shown) the upper completion may be initially deployed. The stinger 870, along with the FCDs 800, may then be deployed through the upper completion. In this case the stinger 870 may be retrieved along with the FCDs 800 through the upper completion without a need for retrieving the upper completion. Although the drawing shows an expandable screen 842, the same embodiments are applicable for other type of screens e.g wire wrapped screen, slotted or perforated pipe, and cased and perforated liner or casing.

While the invention has been disclosed with respect to a limited number of embodiments, those skilled in the art, having the benefit of this disclosure, will appreciate numerous modifications and variations there from. It is intended that the appended claims cover such modifications and variations as fall within the true spirit and scope of the invention.

What is claimed is:

1. A method of completing a well comprising:

installing in a downhole tubing a plurality of retrievable flow control devices where each retrievable flow control device of the plurality corresponds to one of a plurality of formation zones, wherein each retrievable flow control device comprises an engaging protrusion which engages directly with a profile formed in the downhole tubing such that the retrievable flow control device spans the entire internal diameter of the downhole tubing;

establishing communication between a flow control device port of each retrievable flow control device and a corresponding completion port regardless of the rotational orientation of the retrievable flow control device relative to the completion by placing the flow control device port of each retrievable flow control device in a concentric groove;

producing fluid from the one or more formation zones or injecting fluid into one or more formation zones via the flow control device port of each retrievable flow control device and the corresponding completion port;

monitoring a well parameter from each of the one or more formation zones; and retrieving at least one of the one or more retrievable flow control devices and replacing the at least one flow control device with another retrievable flow control device based upon the monitoring results.

2. The method as recited in claim 1, wherein the one or more retrievable flow control devices are installed in a corresponding number of side pockets.

3. The method as recited in claim 1, wherein the plurality of retrievable flow control devices is installed in a screen base pipe.

4. The method as recited in claim 1, wherein the plurality of retrievable flow control devices is configured to be retrieved via a wireline, slick line, or coiled tubing.

5. The method as recited in claim 1, wherein the plurality of retrievable flow control devices is configured for substantially unidirectional fluid flow.

6. The method as recited in claim 1, wherein the installing comprises installing the one or more retrievable flow control devices via a stinger.

7. The method as recited in claim 6, wherein the one or more retrievable flow control devices are positioned to interact with an expandable screen completion.

* * * * *